United States Patent [19]

Nelson

[11] Patent Number: 5,020,632

[45] Date of Patent: Jun. 4, 1991

[54] ACOUSTICAL PARTITION AND METHOD OF MAKING SAME

[75] Inventor: Thomas E. Nelson, Anchorage, Ky.

[73] Assignee: Soltech, Inc., Shelbyville, Ky.

[21] Appl. No.: 345,943

[22] Filed: May 1, 1989

[51] Int. Cl.[5] ..... E04B 1/82; E04B 9/00

[52] U.S. Cl. ..... 181/290

[58] Field of Search ..... 181/284, 287, 290, 293

[56] References Cited

U.S. PATENT DOCUMENTS

| | | | |
|---|---|---|---|
| 1,483,366 | 2/1924 | Mazer | 181/293 |
| 1,875,074 | 8/1932 | Mason | 181/293 |
| 2,285,423 | 6/1942 | Esser | 181/290 |
| 2,824,618 | 2/1958 | Hartsfield | 181/290 X |
| 3,274,046 | 9/1966 | Shannon et al. | 181/290 X |
| 3,949,827 | 4/1976 | Witherspoon | 181/284 |
| 3,971,867 | 7/1976 | Randall | 181/290 X |
| 4,076,100 | 2/1978 | Davis | 181/290 |
| 4,167,598 | 9/1979 | Logan et al. | 181/290 X |
| 4,446,663 | 5/1984 | Stumpf et al. | 181/290 X |
| 4,630,416 | 12/1986 | Lapins et al. | 181/287 X |

*Primary Examiner*—Brian W. Brown

*Attorney, Agent, or Firm*—Woodard, Emhardt, Naughton, Moriarty & McNett

[57] ABSTRACT

An acoustical partition for use in home, office and industrial environments includes a generally rectangular, rigid, hollow frame whose interior opening is filled with an acoustical core wherein the outer planar surfaces of the frame and core are covered with further insulation material and a fabric outer layer. The interior acoustical core is configured with an alternating sequence of insulation material strips wherein the alternating strips of insulation material may either be different materials of the same density, the same material with different densities, different materials and different densities and with all of the foregoing may be either the same or different thicknesses.

11 Claims, 4 Drawing Sheets

ACOUSTICAL PARTITION AND METHOD OF MAKING SAME

BACKGROUND OF THE INVENTION

This invention relates in general to acoustical partitions and in particular to modular (movable) acoustical wall panels for use in office environments. There are several basic design properties such as appearance, feel, rigidity (or structural integrity) and noise abatement which manufacturers of acoustical partitions attempt to provide in the design and construction of their products. Very often a high-density fiberglass material is placed inside of a rigid outer frame and both are covered with a decorative fabric. As one design variation, the fiberglass may have either a soft (low-density) outer layer or a rigid, tackable outer layer placed over both sides of the frame prior to covering the assembly with a decorative outer fabric (cover). It is also common for these somewhat typical partitions to have a rigid septum of steel, paperboard, fiberboard or wood sandwiched between two layers of fiberglass. This sandwich (lamination) may be placed inside of the rigid outer frame in place of a single high-density fiberglass layer.

Most of the foregoing partition assembly concepts rely on either the high-density fiberglass or the sandwiched construction to provide both rigidity and noise abatement properties. However, high-density fiberglass is extremely expensive compared to lower-density fiberglass material and the higher-density material may offer little or no increase in noise abatement properties. Since one of the more significant design properties of acoustical partitions is the degree of noise abatement, the precise selection and arrangement of materials for the partitions becomes part of a critical decision.

Consider for example the three pound per cubic foot density of fiberglass costs more than twice what a 1.5 pound per cubic foot density costs for the same volume of material, yet offers only a slight increase or improvement in noise abatement properties and the same Noise Reduction Coefficient (NRC). The principal reason for use of the higher density fiberglass is obviously not for noise abatement, but rather for rigidity. The following table illustrates the minor increase in noise-absorption properties due to increased density:

| | Absorption Coefficients at Octave Frequencies | | | | |
|---|---|---|---|---|---|
| Density | 250 | 500 | 1000 | 2000 | NRC |
| 1.5 lbs/ft$^3$ (1 inch thick) | 0.54 | 0.76 | 0.83 | 0.87 | 75 |
| 3.0 lbs/ft$^3$ (1 inch thick) | 0.49 | 0.69 | 0.87 | 0.92 | 75 |

Another design variation for acoustical partitions and one which is commonly used is to employ fiberglass in conjunction with a rigid septum such as steel. In this type of construction, a lower density of fiberglass can be used and adequate rigidity can still be maintained. However, the septum can be very expensive, especially if constructed of steel.

In order to deal with what is seen as drawbacks and shortcomings of currently designed acoustical partitions, the present invention has been conceived. The present invention provides excellent rigidity and noise abatement properties without the corresponding high cost (expense) associated with a high-density fiberglass core or septum. This result is achieved by creating a core of sound-absorbing material fabricated from a plurality of sheets of material laminated into a core panel. These laminated sheets may be of the same material but with two different densities and are alternately sequenced in order to create the acoustical core for the partition. Alternatively, the sheets of material may be of two different materials, such as one insulating material and a chip board (or particle board material), and alternated in the lamination for the core. A third option is to do either of the above where the two types of material that are in alternating sequence have different thicknesses. The design concepts and variations of the present invention provide designers with a much greater degree of flexibility in efficiently abating specific types of noise and/or specific frequencies of sound.

There is a spin-off benefit of the present invention with regard to the method of manufacture. Fiberglass and foam insulation which is fabricated in panel form is typically sized into standard widths, such as 48 inches, which is common for three-pound density fiberglass board. If a 30-inch width of core material is required by the acoustical partition manufacturer, the 18 inches which remain initially represent wasted material which in effect increases the cost of the 30-inch panel which is used. Presumably, two 18-inch pieces could be cut down to 15 inches and then joined together for a 30-inch wide panel, but the special nature of this procedure in a shop which is geared to producing 48-inch panels or using 30-inch panels creates manufacturing inefficiencies. The resultant acoustical panel would not have the requisite fit, rigidity or structural integrity which is desired for acoustical partitions.

In the present invention, the standard width panels are stacked side by side on edge and in abutting relationship and a layer approximately the same thickness as the acoustical partition frame is cut from the top of this stacked block of standard-width panels. If each panel is, for example, one inch in thickness, then for a 30-inch width panel for the partition, 30 standard-width panels are stacked on edge. When the cut is made, the only waste is of the saw blade thickness as it cuts through the material. In the described method, if 48-inch panels are used, this 48-inch dimension will in effect be a height dimension for the block of standard-width panels which are abutted together. As successive layers are cut from the top of this panel block, each layer is cut at the desired thickness so as to match the partition frame in which the panel will be placed. The only loss as mentioned is due to the saw blade width and if a 48-inch panel is cut in 1-inch strips by a 1/16-inch thick saw blade, 45 panels will be produced allowing three inches for losses, 2.94 inches of which will be due to the blade thickness.

While a variety of designs exist for acoustical panels, none anticipate or suggest the present invention. Further, it would not be obvious to a person having ordinary skill in the acoustical partition art to combine structural portions from a plurality of references in order to create the present invention. Nonetheless, some of the structural aspects of these partitions may be of interest relative to the present invention, if for nothing more than to illustrate the substantial differences between the present invention and what is disclosed in such references. Consequently, the following list of patent references is provided as being representative of the type of acoustical panels found in the art:

| U.S. Pat. No. | Patentee | Issue Date |
|---|---|---|
| 4,630,416 | Lapins et al. | 12/23/86 |
| 4,167,598 | Logan et al. | 9/11/79 |
| 4,076,100 | Davis | 2/28/78 |
| 3,949,827 | Witherspoon | 4/13/76 |
| 3,274,046 | Shannon et al. | 9/20/66 |

Lapins et al. discloses a movable, prefabricated wall panel having a rigid rectangular frame. A core structure is disposed in the region bounded by the frame which core structure preferably comprises at least one honeycomb layer. Sheet-like skins are fixedly secured to opposite sides of the frame and extend across the region bounded by the frame for confining the honeycomb layer therebetween. Each sheet-like skin is covered by a layer of porous fiberglass material for absorbing sound, and this layer includes an inner thin mat of high-density fiberglass which is in turn covered by relatively thick outer layer of low-density fiberglass. This outer layer has a variable density gradient across the thickness thereof which density gradient progressively increases across the thickness.

Logan et al. discloses a heat and sound insulating panel assembly for a wall, ceiling or floor construction and consists of a plurality of interlocking vacuum-chamber panel elements fabricated from a relatively hard, low thermally conductive fire-resistant or fireproof material with heat-reflective, moisture-restraining coatings on its inner and outer surfaces. Abutting surfaces may be provided with sound-cushioning pads, and vacuum-chamber spacer column elements may be employed, interlocked between panel elements for uniform increased panel wall thickness.

Davis discloses an oil-impervious acoustical board formed of fire-retarding materials which has the properties of being fire-retardant, sound-absorbing, heat insulating and decorative. This acoustical board may be formed in virtually any size and shape and is composed of fiberglass reinforced melamine resin panels having one grooved surface covered by fiberglass cloth with perforations suitable to admit sound waves into the grooved areas of the underlying board. The sound waves which are admitted are intended to be trapped by the design of the acoustical board.

Witherspoon discloses an acoustical panel assembly having improved structural, decorative and acoustical properties wherein the panel includes a perimeter frame, a thin septum member supported in the center of the frame and a fibrous glass layer positioned adjacent each side of the septum member. A molded, semi-rigid fibrous glass diffuser member is positioned adjacent each of the fiberglass layers. This assembly includes means for joining adjacent panel assemblies and, in one embodiment, an outer decorative fabric layer positioned adjacent each of the outer surfaces of the diffuser members.

Shannon et al. discloses a combined fiber and cellular panel including a plurality of bodily separate masses of intermeshed vitreous fibers which masses are disposed in closely adjacent, side-by-side relationship. The fibers in the masses are bonded to one another at points of contact by a binder material. In one embodiment of this device, there is a honeycomb core pattern disposed between a pair of spaced parallel skins. Also disclosed in this patent reference is a procedure or method of fabrication involving creation of a laminar structure composed of 24 phenolformaldehyde bonded glass fiber boards interspersed with 23 layers of novolac composition. The resultant structure is then cut into 24 slices, each slice approximately one inch thick and each cut was parallel to an edge of one of the boards and perpendicular to a major surface thereof.

As mentioned, although there are some features of the foregoing references which may be of interest with regard to the present invention, there are substantial differences between the present invention and what is disclosed by these references, all of which will be apparent from the following descriptions.

SUMMARY OF THE INVENTION

An acoustical partition according to one embodiment of the present invention comprises a rigid frame having sides which define an interior opening, an acoustical core disposed within the interior opening and secured to the rigid frame, the acoustical core having a front side and a back side, and the acoustical core including a series of insulation strips arranged in abutting side-by-side relationship and sized so as to occupy the entirety of the interior opening of the rigid frame and covering means applied over both front and back sides of the acoustical core.

One object of the present invention is to provide an improved acoustical partition.

Related objects and advantages of the present invention will be apparent from the following description.

DESCRIPTION OF THE PREFERRED EMBODIMENT

Figure 1:
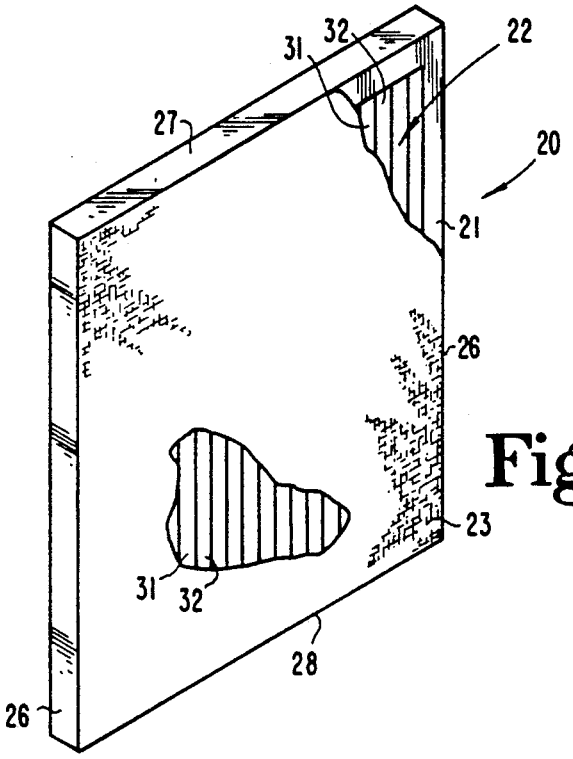
FIG. 1 is a perspective view of an acoustical partition according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated an acoustical partition 20 which includes a generally rectangular frame 21, an acoustical core 22 and an exterior covering 23. Frame 21 includes vertically extending and substantially parallel side portions 26, a top portion (edge) 27 and a bottom portion (edge) 28. Top and bottom portions 27 and 28 are substantially Parallel to each other and substantially perpendicular to side portions 26. The frame may be constructed virtually of any material though in the preferred embodiment, a rigid plastic is molded into hollow sections having a substantially rectangular lateral cross section and which may either be integrally molded into the entirety of frame 21 or may be formed in individual lengths and then mitered together at the corners in order to create frame 21. The substantially rectangular section configuration and the hollow nature of the four frame portions is illustrated in FIGS. 3 and 6–9. An alternative to molded plastic or fiberglass for frame 21 is the use of wood or lightweight metal.

Acoustical core 22 includes a series of insulation strips 31 and 32 arranged in abutting side-by-side relationship so as to occupy the entirety of the interior opening of the frame 21, which interior opening is defined by the interior surface or inside edges of side portions 26, top portion 27 and bottom portion 28.

Figure 2:
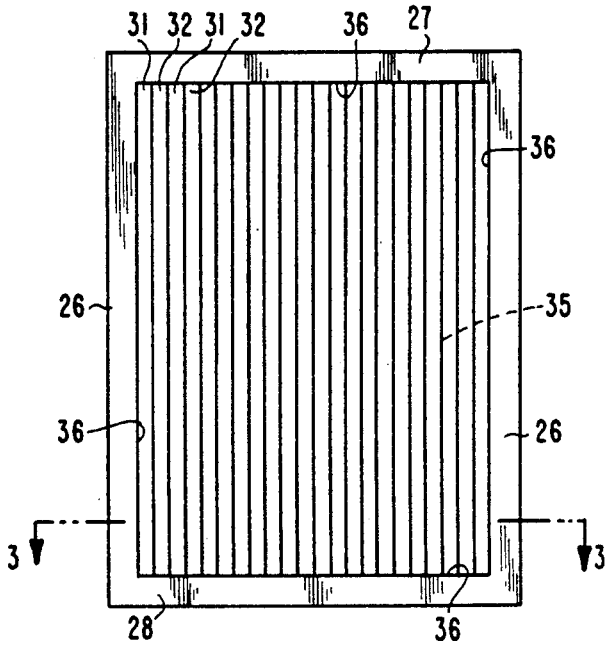
FIG. 2 is a front elevational view of the FIG. 1 acoustical partition with the exterior covering removed.

Referring to FIG. 2, the acoustical partition 20 of FIG. 1 is illustrated as a front elevational view with covering 23 removed so as to better illustrate the configuration of frame 21 and the series of insulation strips 31 and 32 which fill interior opening 35. While strips 31 and 32 are described as "insulation" strips, the present invention contemplates that one strip will be an insulation material, such as fiberglass, and the other (alternating) strip will be a material such as chip board, which can also be considered an "insulating" material but with considerably different properties than fiberglass. Inside edge 36 which is generally rectangular defines interior opening 35. Insulation strips 31 and 32 have been identified as a series and it is intended by the alternate use of two different reference numerals in sequence to indicate that the insulation strips which fill the interior opening actually include a first plurality of insulation strips 31 and a second, alternating plurality of insulation strips 32. The material, density and thickness of insulation strips 31 and 32 will be discussed hereinafter.

Figure 3:
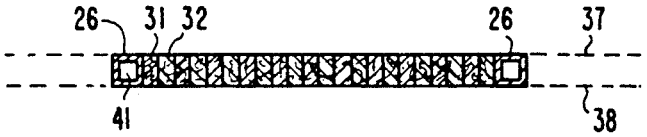
FIG. 3 is a full section view of the partial acoustical partition illustrated in FIG. 2 as viewed in the direction of line 3–3.

With reference to FIG. 3, a lateral cross-sectional view of the acoustical partition 20 is illustrated detailing the fact that the height or thickness of insulation strips 31 and 32 generally coincides with the top surface of side portions 26 as well as the top surface of top portion 27 and bottom portion 28. The substantially planar and parallel nature of the front or top surface of the acoustical partition 20 is diagrammatically illustrated by broken line 37. The back or rear substantially planar surface of acoustical partition 20 is diagrammatically represented by broken line 38. Although top and bottom portions 27 and 28, respectively, are not visible in this lateral sectional view, it is to be understood from the illustration of FIGS. 1 and 2 that the outer surfaces of the four portions which comprise frame 21 are all coplanar with the geometric planes defined by broken lines 37 and 38.

The generally rectangular lateral cross section (in the exemplary embodiment square) and hollow nature of side portions 26 are illustrated in FIG. 3 and the four walls which define each side portion 26 define a enclosed hollow channel 41. It is also to be understood that top portion 27 and bottom portion 28 are similarly configured with this rectangular or square lateral section and if the entire frame is cast or molded as an integral member, the hollow channel 41 extends uninterrupted, completely around the perimeter of the acoustical core 22. This hollow channel may either be left open or may be injected or otherwise filled with some material to add desirable properties such as greater rigidity, greater weight, less vibration and noise abatement.

Figure 4:
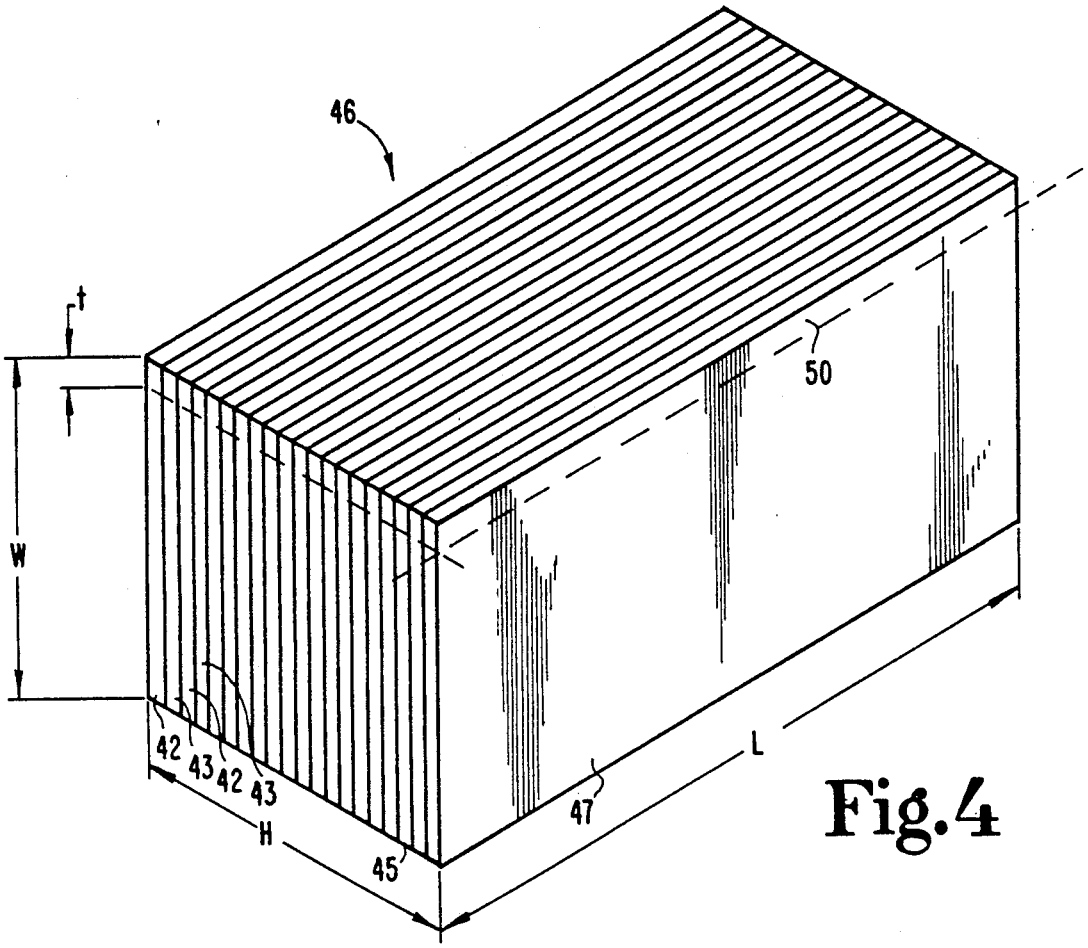
FIG. 4 is a perspective view of a block of insulating panels which are cut to create the acoustical core of the FIG. 1 partition.
Figure 5:
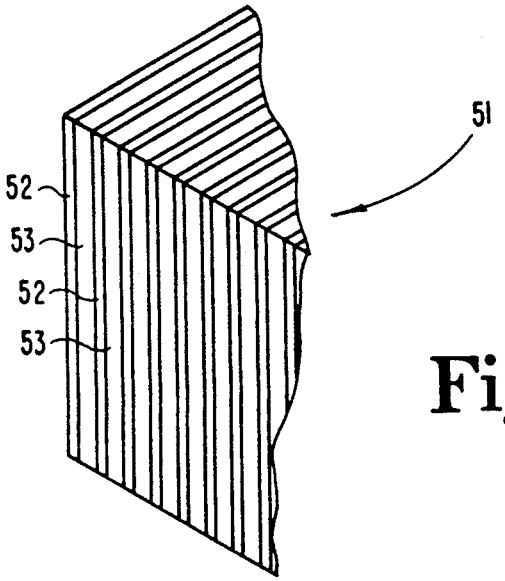
FIG. 5 is a partial, perspective view of an alternative acoustical panel block arrangement according to the present invention.

Referring to FIGS. 4 and 5, a method of manufacturing acoustical core 22 is illustrated. Based upon the foregoing figure illustrations and descriptions, it should be clear that each insulation strip 31 and/or 32 is a generally rectangular solid whose length is substantially equal to the desired height of acoustical partition 20, whose thickness is equal to the thickness of frame 21 and whose width depends upon the number of insulation strips compiled into core 22 and the size of the interior opening 35. One issue is then how to accurately, precisely and uniformly cut these various insulation strips from whatever desired material and material density may be selected based upon the end-use intentions for the acoustical partition and the noise abatement requirements. In the preferred embodiment, fabrication of core 22 begins with the selection of a plurality of panels 42 and 43. The material for panels 42 and 43 may be fiberglass for both or other insulating material or alternatively may be an insulating material for one and a rigid material such as chip board or particle board for the other type of panel. As was described for insulation strips 31 and 32, panels 42 and 43 are alternately arranged in sequence across the entirety of dimension H. As will be seen, dimension H is substantially equal to the interior edge length of top and bottom portions 27 and 28. Each panel 42 and 43 is approximately 48 inches long in the direction of dimension W. This dimension represents the standard or typical panel width of 48 inches which is frequently the manufactured size by the producers of fiberglass panels such as those used in this particular embodiment. The L dimension represents the panel length which may typically be any length, and may vary from application to application. Each panel 42 and 43 is set on its edge such that its width dimension of 48 inches extends vertically and its length dimension of 8, 10 or 12 feet extends horizontally. As is illustrated, the front and back planar surfaces of adjacent panels abut against one another. In order to utilize the resultant layer which is to be cut from panel block 46, a suitable adhesive is applied between each panel 42 and 43 so as to join those panels rigidly together in to a solid block as the initial or starting point for the fabrication of core 22. Once the adhesive or bonding material fully sets up or cures, cuts are made in a direction parallel to edges 45 and perpendicular to planar surface 47. The layer 50 which is removed by this cut consists of a bonded series of insulation strips 31 and 32, which have a thickness of "t" which is equal to the distance between the planar surfaces represented by lines 37 and 38 and these insulation strips have a length equal to "L". The width of the layer 50 is equal to dimension H.

Although it has been described that panels 42 and 43, as used in block 46, may be any length, in fact, in one set of embodiments, the L dimension should be equal to the height of the core for the acoustical panel or an even multiple thereof so as to maximize the efficiency of a larger size and eliminate any wasted material. In another set of embodiments, the L dimension is equal to the width of the core for the acoustical panel. For example, if one desires to have an acoustical panel whose acoustical core is approximately 5 feet high, then the L dimension of block 46 could either be approximately 5 feet, 10 feet or 15 feet. The only increase to the resultant height of the acoustical partition will be the thickness of the top and bottom portions 27 and 28.

In order to produce multiple acoustical cores for acoustical partitions according to this invention, additional horizontal cuts are made to block 46 progressively removing layer after layer from the top of the remaining block. It is also to be noted that a single block of bonded panels 42 and 43 may be used for a wide range of partitions of different thicknesses as well as different heights, but the width of the partition which is to be created from block 46 should remain consistent and equal to dimension H so as to eliminate waste in that dimension. If cuts of uniform thickness are taken in block 46, then a 48-inch panel (42 or 43) can be cut by a 1/16-inch thick sawblade into 45 insulation strips with the only material loss being that due to the saw blade thickness.

Referring to FIG. 5, a partial block 51 of bonded insulation panels is illustrated. In this particular arrangement, panels 52 and 53 are alternately and sequentially arranged relative to each other and as illustrated, panel 52 is thinner than panel 53. The illustration of FIG. 5 is intended to provide one variation as to what is illustrated in FIG. 4, namely that the alternating insulation panels can be of different thicknesses. In FIG. 4, panels 42 and 43 were illustrated as being of virtually the same or identical thickness while in block 51 (FIG. 5), panels 52 and 53 are of different thicknesses. Another variation which is possible with regard to panels 42 and 43 as well as with panels 52 and 53 is to provide panels of different material densities, though of the same material. For example, panel 42 could be of a 3 $lb/ft^3$ fiberglass density while panel 43 would be of a 1.5 $lb/ft^3$ fiberglass density. Likewise, one panel of the alternating series of panels may be a chip board material in lieu of fiberglass or other insulating material. This chip board material, if used for one of the two panel styles may vary in thickness as well as density, such as a 1-pound density chip board or a 3-pound density chip board.

A similar configuration is possible with regard to panels 52 and 53. Panel 52 could be configured not only as a thinner panel as illustrated, but also of a higher density, thus making it a more rigid panel per unit thickness. Another variation with regard to panels 42 and 43 as well as with panels 52 and 53 is to make the respective panels out of different material. In other words, panel 42 could be of a first type of material and panel 43 of a different material. Likewise, panel 52 could be of one material and panel 53 of a different material. A still further variation with regard to the illustrated blocks of FIGS. 4 and 5 is to make the panels both out of different material and with a different density. By way of example, panel 42 could be of a 3 lb density fiberglass and panel 43 could be a 1.5 lb density styrofoam or polystyrene. A similar option as to different materials with different densities exists for panels 52 and 53 which would provide a further variation, namely panel thickness. Finally, although panels 42 and 43 as well as panels 52 and 53 have been illustrated as a sequential or alternating combination, it is possible to create virtually any desired permutation of these panels. For example, one option would be to arrange two panels 42 side by side and then a panel 43 and then two more panels 42 and then another panel 43 and so forth. Instead of a 2-1-2-1 configuration, another arrangement would be a 3-1-3-1 or a 3-2-3-2 panel grouping. As should be apparent, the variety and versatility are virtually endless and that is one of the strong selling points of the present invention which allows a designer to specifically tailor the acoustical partition to the environment and to specifically design and tailor the material selection and arrangement of the panels for optimal noise abatement.

Figure 7:
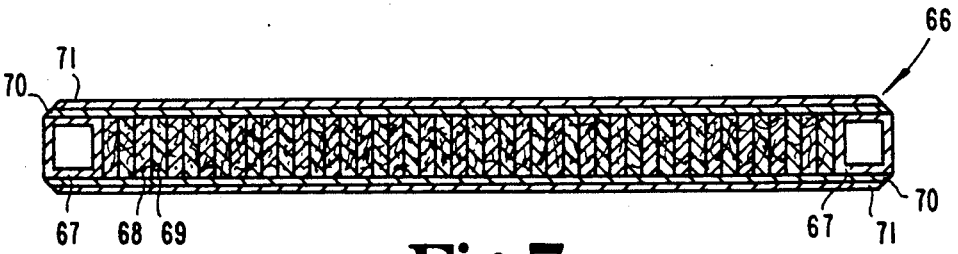
FIG. 7 is a full section view of the lateral thickness of an acoustical partition according to the present invention.
Figure 8:
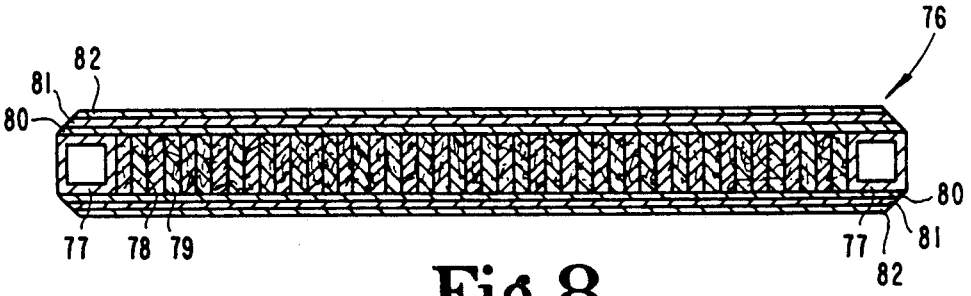
FIG. 8 is a full section view of the lateral thickness of an acoustical partition according to the present invention.
Figure 8A:
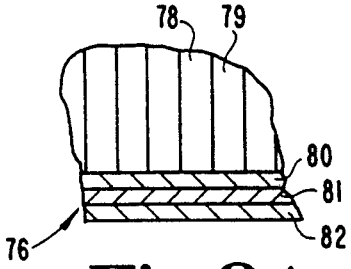
FIG. 8A is a partial, enlarged detail of the covering lamination structure of the FIG. 8 partition.
Figure 9:
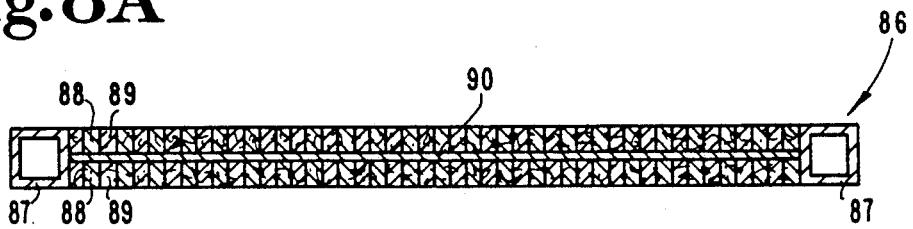
FIG. 9 is a full section view of the lateral thickness of an acoustical partition according to the present invention.

Although these various panel combinations, material selections, densities and thicknesses are an option, those options have been disregarded with regard to the illustrations of FIGS. 6–9 since those illustrations are intended to focus on the exterior covering of the acoustical partition (FIGS. 6, 7, 8 and 8A) and the design of a septum (FIG. 9). It is intended that with each of the designs described and illustrated with regard to FIGS. 6–9 all of the foregoing panel variations and arrangements would be applicable and fully compatible with the different covering options which are described with regard to those figures.

Figure 6:
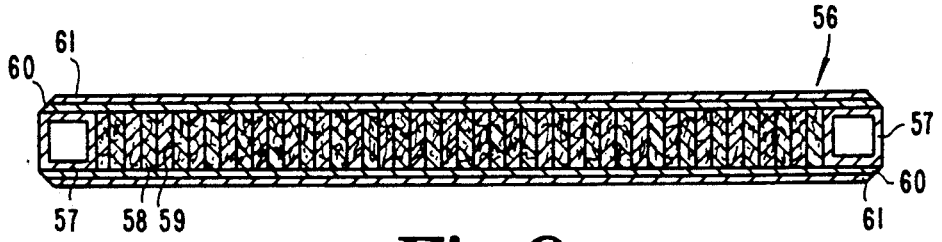
FIG. 6 is a full section view of the lateral thickness of an acoustical partition according to the present invention.

Referring to FIG. 6, there is illustrated a lateral cross-sectional view of an acoustical partition 56 which includes side portions 57, insulation strips 58 and 59, and an exterior covering on the outer surface of both sides. The covering includes a first layer 60 of a soft insulating material which overlays the top and bottom planar surfaces of the acoustical core, generally coinciding to the planar surfaces defined by broken lines 37 and 38. Overlaying the soft insulating material 60 is a fabric covering 61, all of which are joined or bonded together so as to create an integral acoustical partition.

Referring to FIG. 7, the lateral cross-sectional view of acoustical partition 66 illustrates side portions 67, insulating strips 68 and 69 and exterior covering which includes a first layer 70 which is of a rigid, tackable material applied to the outer planar surfaces of the acoustical core. Layer 70 is then covered with a fabric layer 71 also on both outer surfaces so as to complete the assembly of partition 66.

Referring to FIG. 8 and the enlarged partial detail of FIG. 8A, acoustical partition 76 includes portions 77, insulating strips 78 and 79 and an exterior covering of three layers beginning with a rigid, tackable material layer 80 directly against the outer planar surfaces of the core and frame. This tackable layer 80 is then covered with a soft layer 81 which in turn is covered with a fabric layer 82.

Referring to FIG. 9, a lateral cross-sectional view of partition 86 is illustrated with side portions 87, insulating strips 88 and 89 and a septum 90. It is to be noted that in the illustration of FIG. 9, while varying panels have not been illustrated as in FIG. 5, all of the foregoing panel variations are equally applicable to the design of FIG. 9 with the further variation that the insulating strips on one side of the septum may either be the same as or different from the strips on the under or opposite side of septum 90. Consequently, by the use of septum 90, even greater variation is permitted in the design of partition 86. It is also to be noted with regard to FIG. 9 that the various covering options of FIGS. 6–8 are not illustrated and it should be noted that any of those are equally applicable as part of partition 86.

Septum 90 is disposed in the approximate midpoint of the thickness of partition 86 and completely fills the interior opening and is rigidly joined to the inside surface or edge of the entire frame. The result is that septum 90 in combination with the surrounding generally rectangular and rigid frame creates a box-like volume into which the insulating strips 88 and 89 are placed. On the opposite side of septum 90 another box-like volume is created which is also suitable to receive either the same insulating strips 88 and 89 or different configured insulating strips. Septum 90 provides additional rigidity for partition 86 and it is possible to have septum 90 integrally molded as part of the frame or separately manufactured and assembled to the frame. The insulating strips may be applied to the septum before assembly to the frame or after the septum is assembled.

Figure 10:
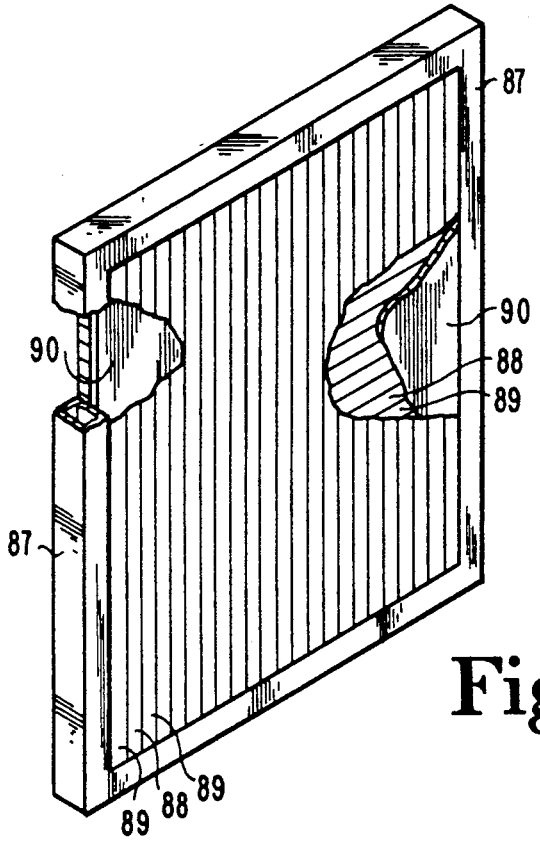
FIG. 10 is a perspective view of an acoustical partition according to a typical embodiment of the present invention.

Referring to FIG. 10, a further variation to the panels of FIG. 9 is illustrated by means of an acoustical partition 94. In all of the foregoing embodiments, the individual strips cut from each panel are arranged in a vertically extending direction such that the length of each strip is approximately equal to the vertical height of the core portion of the corresponding acoustical partition. One variation (as illustrated in FIG. 10 by panel 94) is to turn the strips on one side of septum 90 ninety degrees so that they extend in a generally horizontal direction. The effect of having one series of strips 88 and 89 extending in a horizontal direction on one side of the septum and a second series of strips 88 and 89 extending in a vertical direction on the other side of septum 90 is to create a lattice or checkerboard-type configuration.

Figure 11:
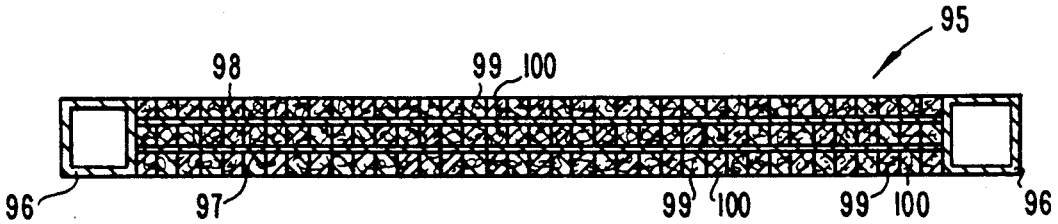
FIG. 11 is a full section view of the lateral thickness of an acoustical partition according to the present invention.

Referring to FIG. 11, there is illustrated, in lateral full section, acoustical partition 95 which includes side portions 96 of the surrounding frame for the core, first septum 97, second septum 98 and insulating strips 99 and 100. In the FIG. 9 partition as well as in the partition 95 of FIG. 11 the insulating strips on one side of the septum(s) may be in alignment with like strips on the opposite side as in FIG. 9 or the strips may be alternated such that strips 88 on one side are directly across from strips 89 on the opposite side of the septum.

Further, for all of the partitions of FIGS. 6–11, the insulating strips may differ from each other as to material, thickness and density in a wide variety of permutations. The number of options increase with the two-septum, three-core design of FIG. 11. The possibilities are limited only by the creativity of the designer as to what materials, densities, thickness and strip pattern may be employed. The different strip pattern of vertical strips on one side of the septum and horizontal strips on the opposite side of the septum has additional possible variations depending on the three core layering of vertical and horizontal patterns.

Figure 12:
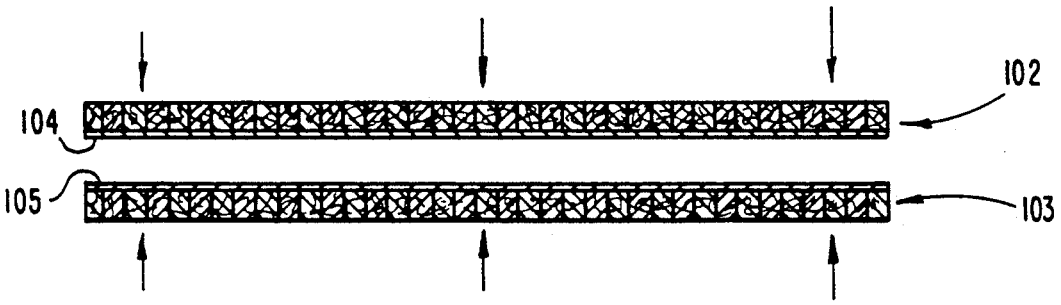
FIG. 12 is a diagrammatic illustration of a split-septum arrangement suitable for use in the present invention.

A further variation to all of the foregoing embodiments employing either one or two septums, or more if desired, is to split each septum into two half-thick layers. The reason for such a variation is to improve the handling and assembly of the core strips. Although the insulation strips are bonded together into a full panel equal to the core size, this panel must be handled in order to bond the panel to the septum and assemble the core into the surrounding frame. If the septum is split into two layers, each layer being one-half of the normally designed thickness, and after each core panel side is joined to its septum layer, handling is made easier. This fabrication technique is diagrammatically illustrated in FIG. 12. Once the insulating core panels are assembled to their respective septum layers, partial panels 102 and 103 are created. The final assembly is achieved by bonding together the two half-thick septum layers 104 and 105.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An acoustical partition comprising:

a rigid frame including a top portion, a bottom portion, a first side portion and an oppositely disposed second side portion which collectively define an interior opening;

an acoustical core disposed within said interior opening, secured to said rigid frame; and said acoustical core including an abutting side-by-side, laterally stacked series of insulation strips sized so as to occupy the interior opening of said rigid frame, the lateral stacking of said insulation strips extending from said first side portion to said second side portion, wherein said series of insulation strips includes a first plurality of insulation strips of a first material and a second plurality of insulation strips of a second material which is different from said first material.

2. An acoustical partition comprising:

a rigid frame including a top portion, a bottom portion, a first side portion and an oppositely disposed second side portion which collectively define an interior opening;

an acoustical core disposed within said interior opening, secured to said rigid frame; and said acoustical core including an abutting side-by-side, laterally stacked series of insulation strips sized so as to occupy the interior opening of said rigid frame, the lateral stacking of said insulation strips extending from said first side portion to said second side portion, wherein said series of insulation strips includes a first plurality of insulation strips of a first material with a first density and a second plurality of insulation strips of a second material with a second density, wherein said first and second materials are different from each other and said first and second densities are different from each other.

3. The acoustical partition of claim 2 wherein the insulation strips of said first and second pluralities each having a thickness dimension and the thickness dimension of said insulation strips of said second plurality is smaller than the thickness dimension of said insulation strips of said first plurality.

4. An acoustical partition comprising:

a rigid frame including a top portion, a bottom portion, a first side portion and an oppositely disposed second side portion which collectively define an interior opening;

an acoustical core disposed within said interior opening, secured to said rigid frame;

said acoustical core including an abutting side-by-side, laterally stacked series of insulation strips sized so as to occupy the interior opening of said rigid frame, the lateral stacking of said insulation strips extending from said first side portion to said second side portion; and means for covering said acoustical core, said covering means being applied over both front and back sides of said acoustical core, wherein said covering means includes, on each side of said acoustical core, a first layer of insulation material covered by an outer, second layer of fabric.

5. An acoustical partition comprising:

a rigid frame having sides which define an interior opening;

an acoustical core disposed within said interior opening, secured to said rigid frame and having a front side and a back side;

said acoustical core including a series of insulation strips arranged in abutting side-by-side relationship and sized so as to occupy the interior opening of said rigid frame, said series of insulation strips including a first plurality of insulation strips of a first material and a second plurality of insulation strips of a second material which is different from said first material, said insulation strips of said first plurality being disposed in alternating sequence with insulation strips of said second plurality in creating said acoustical core, and wherein the insulation strips of said first plurality and the insulation strips of said second plurality have substantially a same size and shape; and means for covering said acoustical core, said covering means being applied over both front and back sides of said acoustical core.

6. An acoustical partition comprising:

a rigid frame including a top portion, a bottom portion, a first side portion and an oppositely disposed second side portion which collectively define an interior opening;

an acoustical core disposed within said interior opening, secured to said rigid frame; and said acoustical core including an abutting side-by-side, laterally stacked series of insulation strips sized so as to occupy the interior opening of said rigid frame, the lateral stacking of said insulation strips extending from said first side portion to said second side portion, said series of insulation strips includes a first plurality of insulation strips of a first material and a second plurality of insulation strips of a second material which is different from said first material, said insulation strips of said first plurality being disposed in alternating sequence with insulation strips of said second plurality.

7. The acoustical partition of claim 6 wherein the insulation strips of said first plurality and the insulation strips of said second plurality have substantially a same size and shape.

8. An acoustical partition comprising:

a rigid frame including a top portion, a bottom portion, a first side portion and an oppositely disposed second side portion which collectively define an interior opening;

an acoustical core disposed within said interior opening, secured to said rigid frame; and said acoustical core including an abutting side-by-side, laterally stacked series of insulation strips sized so as to occupy the interior opening of said rigid frame, the lateral stacking of said insulation strips extending from said first side portion to said second side portion, said series of insulation strips includes a first plurality of insulation strips of a first material with a first density and a second plurality of insulation strips of a second material with a second density, wherein said first and second materials are different from each other and said first and second densities are different from each other, said insulation strips of said first plurality being disposed in alternating sequence with insulation strips of said second plurality.

9. The acoustical partition of claim 8 wherein the insulation strips of said second plurality have a greater material density than the insulation strips of said first plurality.

10. The acoustical partition of claim 9 wherein the insulation strips of said first and second pluralities each having a thickness dimension and the thickness dimension of said insulation strips of said second plurality is smaller than the thickness dimension of said insulation strips of said first plurality.

11. The acoustical partition of claim 9 which further includes an acoustical partition comprising:

means for covering said acoustical core, said covering means being applied over both front and back sides of said acoustical core, wherein said covering means includes on each side of said acoustical core, a first layer of insulation material covered by an outer, second layer of fabric.

* * * * *